US005207981A

United States Patent [19]

Hanaue et al.

[11] Patent Number: 5,207,981

[45] Date of Patent: May 4, 1993

[54] HEAT RESERVING MATERIALS USUABLE AT VERY LOW TEMPERATURES

[75] Inventors: Yasuhiro Hanaue; Etsuji Kimua; Takuo Takeshita; Kouichi Ishiyama, all of Omiya; Masashi Nagao, Amagasaki; Takashi Inaguchi, Amagasaki; Hideto Yoshimura, Amagasaki, all of Japan

[73] Assignees: Mitsubishi Materials Corporation; Mitsubishi Denki Kabushiki Kaisha, both of Tokyo, Japan

[21] Appl. No.: 766,769

[22] Filed: Sep. 27, 1991

[30] Foreign Application Priority Data

Sep. 28, 1990 [JP] Japan ..... 2-259282
Jun. 11, 1991 [JP] Japan ..... 3-165151

[51] Int. Cl.[5] ..... C22C 5/00
[52] U.S. Cl. ..... 420/416; 420/462
[58] Field of Search ..... 420/416, 462

[56] References Cited

U.S. PATENT DOCUMENTS 3,684,495 8/1972 Wilhelm et al. ..... 420/416
4,082,138 4/1978 Miedema et al. ..... 420/416
4,849,017 7/1989 Sahashi et al. ..... 420/416

FOREIGN PATENT DOCUMENTS 3241165 10/1988 Japan ..... 420/416

*Primary Examiner*—Upendra Roy
*Attorney, Agent, or Firm*—Webb, Burden, Ziesenheim & Webb

[57] ABSTRACT

The present invention provides heat reserving materials comprising alloys of Ru and at least one rare earth metal which are represented by the formula (I):

$$(A_{1-x}B_x)_zRu_{1-y}C_y$$

wherein A represents one or two or more of Er, Ho and Dy; B represents one or two or more of the other rare earth metals; C represents one or two or more of Co, Ni, Al, Cu, Pd, Rh, Au, Ag, Cr, Mn, V and B; x is not less than 0 and not more than 0.5; y is not less than 0 and less than 1.0; and z is more than 1.1 and less than 5.0.

When the heat reserving materials of the present invention are used in a cryogenic refrigerator, very low temperatures of not higher than 10 K. can be achieved. Specific heat properties of the materials can be varied as desired by adjusting the content ratio of the plural phases each of which has a different magnetic transition temperature.

2 Claims, No Drawings

HEAT RESERVING MATERIALS USUABLE AT VERY LOW TEMPERATURES

FIELD OF THE INVENTION

This invention relates to heat reservoir materials for cryogenic refrigerators.

BACKGROUND OF THE INVENTION

As applications of superconductivity such as MRI and SQUID develop, there is an urgent need for cryogenic refrigerators which achieve very low temperatures of from a few K. to some tens K. more facilely and more stably. Helium gas is usually used as a refrigerant in such refrigerators, which is repeatedly compressed and expanded to make a cooled section. Heat is pumped up from the cooled section to the hot section by means of a heat accumulator or a heat exchanger. Since the refrigerator using the heat accumulator is relatively simple in its structure, it is suitably used as a compact refrigerator installed in apparatuses. Typical examples of this type of refrigerator are the Stirling refrigerator and the Gifford-McMahon refrigerator.

Heat reserving materials which have a large specific heat capacity and a good heat conductivity at the working temperature are desired for use in the refrigerator of the heat accumulating type. Copper, lead and alloys thereof are conventionally used for this purpose since the specific heat thereof does not drop until relatively low temperatures while the heat conductivity thereof is good.

Heat capacity of these metals or alloys, however, results from the lattice vibration and accordingly the specific heat thereof rapidly drops as the temperature is lowered to 10–20 K. Therefore, it was difficult to achieve a very low temperature lower than 20 K., especially lower than 10 K. by using a refrigerator in which these metals or alloys were used as a heat reserving material. Very low temperatures of a few K., e.g. the liquid helium temperature (4.2 K. under atmospheric pressure) could not be achieved by these refrigerators.

Magnetic substances having an anomalous specific heat caused by magnetic transition were proposed as heat reserving materials in place of the conventionally used copper and lead. For example, Japanese Patent Publication No. 52-30473(1977) suggests Rh-based intermetallic compounds comprising Rh and at least one element selected from a group of Sm, Gd, Tb and Dy and/or a group of Ho, Er, Tm and Yb such as GdRh and $Gd_{0.5}Er_{0.5}Rh$ Japanese Laid Open Patent Publication No. 61-86420(1986) describes magnetic substances comprising Er, Al and O in specific content ratios. Japanese Laid Open Patent Publication No. 1-310269(1989) describes a heat accumulator in which alloys of a wide-ranging composition represented by the formula $AM_z$ are used wherein A is a lanthanoid except Lu, M is Ni, Co and/or Cu and z is not less than 0.001 and not more than 9.0.

These alloys have a local maximum of volume specific heat at a temperature of not higher than 30 K. which results from a large entropy increase/decrease caused by the order-disorder transition of the spin system which occurs at a temperature of not higher than 30 K. However, as is described in these specifications, the peak value and the peak temperature widely changes depending on the composition of the alloy. Furthermore, there is no example where the liquid helium temperature is achieved by using these alloys as heat reserving materials.

We studied magnetic properties of superconductive materials and found that $R_3Ru$ (wherein R represents rare earth metals), which has not yet been studied as a rare earth metal heat reserving material, has excellent properties as cryogenic heat reserving materials and our further study on Ru alloys revealed that intermetallic compounds represented by the formulae $R_{5/2}Ru$ and $R_{5/3}Ru$, mixture thereof as well as Ru-based alloys having a similar composition also have excellent properties as cryogenic heat reserving materials. (The composition of these compounds has not yet been strictly confirmed. We use $R_{5/2}Ru$, $R_{5/3}Ru$ and the like as representative expressions of the intermetallic compound which has a composition substantially identical or close to the composition represented by these formulae. For example, $R_{44/25}Ru$ and $R_{73/27}Ru$ are also represented by these formulae in this specification.)

DESCRIPTION OF THE INVENTION

Thus the object of the present invention is to provide heat reserving materials comprising alloys of Ru and at least one rare earth metal which are represented by the formula (I):

$$(A_{1-x}B_x)_zRu_{1-y}C_y$$

wherein

A represents one or two or more of Er, Ho and Dy;

B represents one or two or more of the other rare earth metals;

C represents one or two or more of Co, Ni, Al, Cu, Pd, Rh, Au, Ag, Cr, Mn, V and B;

x is not less than 0 and not more than 0.5;

y is not less than 0 and less than 1.0; and z is more than 1.1 and less than 5.0.

Alloys usable in the present invention are typically the intermetallic compounds represented by the formulae $R_3Ru$, $R_{5/2}Ru$ and $R_{5/3}Ru$ wherein R represents one or two or more of Er, Ho and Dy which are represented as Constituent A in the above-mentioned formula (I) and the other rare earth metals represented as Constituent B in the formula (I). Constituent A is preferable to Constituent B with regard to the specific heat of the alloy. A part of Constituent A, preferably not more than 0.4 in molar ratio thereof, can be replaced with Constituent B. It is also preferred that Constituent A contains Er in an amount of not less than 20 wt %. Examples of these intermetallic compounds include the following intermetallic compounds:

(Ia) $A_3Ru$ Type: $Dy_3Ru$, $Ho_3Ru$, $Er_3Ru$, $Dy_{3/2}Ho_{3/2}Ru$, $Dy_{3/2}Er_{3/2}Ru$, $Ho_{3/2}Er_{3/2}Ru$, $DyEr_2Ru$, $HoEr_2Ru$, $Dy_2ErRu$, $Ho_2ErRu$, DyHoErRu and the like;

(Ib) $(A_{1-x}B_x)_3Ru$ Type: $Dy_{5/2}La_{1/2}Ru$, $Ho_{5/2}Yb_{1/2}Ru$, $Ho_{5/2}Tm_{1/2}Ru$, $Er_{5/2}Gd_{1/2}Ru$, $Er_{5/2}Pr_{1/2}Ru$ and the like;

(IIa) $A_{5/2}Ru$ Type: $Dy_{5/2}Ru$, $Ho_{5/2}Ru$, $Er_{5/2}Ru$, $Dy_{5/4}Ho_{5/4}Ru$, $Dy_{5/4}Er_{5/4}Ru$, $Ho_{5/4}Er_{5/4}Ru$, $Dy_{3/2}HoRu$, $Dy_{3/2}ErRu$, $Ho_{3/2}ErRu$, $DyHo_{3/2}Ru$, $DyEr_{3/2}Ru$, $HoEr_{3/2}Ru$, $Dy_{1/2}HoErRu$, $DyHo_{1/2}ErRu$, $DyHoEr_{1/2}Ru$ and the like;

(IIb) $(A_{1-x}B_x)_{5/2}Ru$ Type: $Dy_2La_{1/2}Ru$, $Ho_2Yb_{1/2}Ru$, $Ho_2Tm_{1/2}Ru$, $Er_2Gd_{1/2}Ru$, $Er_2Pr_{1/2}Ru$ and the like;

(IIIa) $A_{5/3}Ru$ Type: $Dy_{5/3}Ru$, $Ho_{5/3}Ru$, $Er_{5/3}Ru$, $Dy_{5/6}Ho_{5/6}Ru$, $Dy_{5/6}Er_{5/6}Ru$, $Ho_{5/6}Er_{5/6}Ru$, $Dy_{2/}$-

$_3$HoRu, $Dy_{2/3}ErRu$, $Ho_{2/3}ErRu$, $DyHo_{2/3}Ru$, $DyEr_{2/3}Ru$, $HoEr_{2/3}Ru$ and the like;

(IIIb) $(A_{1-x}B_x)_{5/3}Ru$ Type: $DyLa_{2/3}Ru$, $HoYb_{2/3}Ru$, $HoTm_{2/3}Ru$, $ErGd_{2/3}Ru$, $ErPr_{2/3}Ru$ and the like;

Ru can be partly replaced with one or more of Co, Ni, Al, Cu, Pd, Rh, Au, Ag, Cr, Mn, V and B (the above-mentioned Constituent C). The temperature where the magnetic specific heat capacity appears can be finely adjusted. It is preferred that the substitution by Constituent C is limited in a ratio of not more than 0.4 (i.e. $y \leqq 0.4$ in the above formula (I)) in consideration of the specific heat of the alloy. Examples of these alloys include various intermetallic compounds and alloys such as $Er_3Ru_{0.6}Cu_{0.4}$, $Er_3Ru_{0.6}Ni_{0.4}$, $Ho_3Ru_{0.9}Co_{0.1}$, $Ho_{2.5}Ru_{0.6}Ni_{0.4}$ and $Ho_2ErRu_{0.8}AgCu_{0.2}$.

Alloys comprising two or more phases of the above-mentioned $R_3Ru$, $R_{5/2}Ru$ and $R_{5/3}Ru$ can be also used in the present invention. Since the eutectic points are present between these phases, molten alloys can be obtained at a relatively low temperature in an intermediate composition, which facilitates the handling and production of the heat reserving material.

The molar ratio of the rare earth metals to the rest ("z" in the above-mentioned formula(I)) is limited to the range of 1.1 to 5.0, preferably 1.5 to 3.6. When the z is less than 1.1, the melting point of the alloy significantly rises and specific heat properties deteriorates, which may be attributed to the presence of $RRu_2$ phase in the alloy. When the z is more than 5.0, the R phase ratio in the alloy increases and deteriorates the specific heat properties.

The materials of the present invention can be used in a desired form, preferably in particles having an average particle size of 0.1 to 3 mm. The production thereof can be carried out following the conventional process.

Specific Disclosure of the Invention

The object and the feature of the present invention will be made more apparent by the following examples. It should be appreciated that the following examples are to illustrate the present invention and not to limit the scope thereof.

The effect of heat reserving materials is estimated by using the material in a 3-step GM (Gifford-McMahon) refrigerator. This refrigerator comprises a compressor which compresses helium gas and a expander which expands the gas to complete the cooling cycle. The compressor has a gas supply pressure of 2.1 MPa and a gas suction pressure of 0.6 MPa. The expander comprises three cylinders having different diameters, each of which has a displacer with a heat accumulator installed therein. 150 mesh wire-nettings of phosphor bronze are used in the first heat accumulator. The second heat accumulator is filled with lead particles having a particle size of 0.3–0.5mm and the third heat accumulator is filled with the heat reserving material indicated below.

Example 1

82.8 g of Dy (99.9% purity) and 17.2 g of Ru (99.9% purity) were heated and molten in an arc melting furnace under Ar atmosphere. The arc furnace had been evacuated to $10^{-4}$ torr in order to prevent oxidation of the metals and the electrodes and then Ar gas was introduced until the pressure increased to 1.1 atm.

The thus prepared alloy was pulverized and analyzed by the powder X-ray diffraction method. The alloy was identified to be $Dy_3Ru$.

Powders of the alloy having a particle size of 0.25–0.5 mm were screened and used in the third step of the 3-step GM refrigerator. The lowest temperature achieved was 7.3 K.

Examples 2–13

The preparation, analysis and working test were repeated following the procedure of Example 1 except that the combination and the content ratio of the metals were varied. Working conditions of the refrigerator such as strokes and rotation ratio were the same as in the Example 1. The results are summarized in the following Table 1.

It should be noted that the liquidation of helium was achieved in Examples 3, 5, 8, 10 and 12.

Comparative Examples 1–3

The preparation and working test were carried out following the procedure of Example 1 except that heat reserving materials of the prior art were used. Lead particles having a particle size of 0.3–0.5 mm, which was the most typical heat reserving material were used in Comparative Example 1. GdRh which had been pulverized to particles having a particle size of 0.25 to 0.5 mm was used in Comparative Example 2 as an Example of Rh-based heat reserving material. $HoCu_2$ used in Comparative Example 3 was an example of the heat reserving material disclosed in the Japanese Laid-open Patent Publication NO. 1-310269(1989). The lowest temperature achieved was measured. The results are also summarized in the following Table 1.

TABLE 1

| No. | Formula | Comp. (Wt %) | Lowest Temp Achieved |
|---|---|---|---|
| Ex. 1 (Ia) | $Dy_3Ru$ | Dy: 82.8<br>Ru: 17.2 | 7.3 K. |
| Ex. 2 (Ia) | $Ho_3Ru$ | Ho: 83.0<br>Ru: 17.0 | 6.6 K. |
| Ex. 3 (Ia) | $Er_3Ru$ | Er: 83.2<br>Ru: 16.8 | 4.2 K. |
| Ex. 4 (Ia) | $Dy_{1.5}Er_{1.5}Ru$ | Dy: 40.9<br>Er: 42.1<br>Ru: 17.0 | 4.9 K. |
| Ex. 5 (Ia) | $Ho_{1.5}Er_{1.5}Ru$ | Ho: 41.3<br>Er: 41.9<br>Ru: 16.9 | 3.8 K. |
| Ex. 6 (Ia) | $Er_{2.7}Gd_{0.3}Ru$ | Er: 75.3<br>Gd: 7.9<br>Ru: 16.8 | 4.8 K. |
| Ex. 7 (Ia) | $Ho_3Ru_{0.9}Co_{0.1}$ | Ho: 83.6<br>Ru: 17.0<br>Co: 1.0 | 6.4 K. |
| Ex. 8 (IIa) | $Er_{2.5}Ru$ | Er: 80.5<br>Ru: 19.5 | 4.0 K. |
| Ex. 9 (IIa) | $Ho_{2.5}Ru$ | Ho: 80.3<br>Ru: 19.7 | 5.0 K. |
| Ex. 10 (IIa) | $Ho_{1.25}Er_{1.25}Ru$ | Ho: 40.2<br>Er: 40.3<br>Ru: 19.5 | 3.7 K. |
| Ex. 11 (IIa + IIIa) | $Ho_{2.5}Ru$ + $Ho_{5/3}Ru$ | Ho: 79.2<br>Ru: 20.8 | 4.9 K. |
| Ex. 12 (IIa + IIIa) | $(Ho, Er)_{2.5}Ru$ + $(Ho, Er)_{5/3}Ru$ | Ho: 40.5<br>Er: 40.5<br>Ru: 19.0 | 4.5 K. |
| Ex. 13 (Ia) | $(Er_{0.5}Ho_{0.5})_{3.4}Ru$ | Ho: 43<br>Er: 43<br>Ru: 15 | 3.7 K. |
| Comp. Ex. 1 | Pb | | 6.8 K. |
| Comp. Ex. 2 | GdRh | | 5.4 K. |

TABLE 1-continued

| No. | Formula | Comp. (Wt %) | Lowest Temp Achieved |
|---|---|---|---|
| Comp. Ex. 3 | $HoCu_2$ | | 9.1 K. |

*NOTE to TABLE 1:

1: Designations Ia, IIa and the like indicate the type of intermetallic compounds.

2: The formula of Example 13 corresponds to the theoretical composition calculated from that of the starting materials. Powder X-ray diffraction shows that the alloy comprises phases like $Er_3Ru$ and $Ho_3Ru$. No other phase was apparently observed.

The heat reserving materials of the present invention have very low magnetic transition temperatures and therefore when they are used in a cryogenic refrigerator, very low temperatures of not higher than 10 K. and even a few K. can be achieved. Furthermore, they may comprise plural phases each of which has a different magnetic transition temperature and the content ratio thereof can be varied by controlling the ratio of rare earth metal to Ru in a relatively wide range (i.e. from 1.1 to 5.0). Accordingly, materials which exhibit magnetic specific heat in a wide range of temperature as desired can be obtained according to the present invention.

What we claim is:

1. Heat reserving materials comprising alloys of Ru and at least one rare earth metal which are represented by formula (I):

$$(A_{1-x}B_x)_zRu_{1-y}C_y$$

wherein

A represents one or two or more of Er, Ho and Dy, wherein the content ratio of Er in A is not less than 20 wt. %;

B represents one or two or more of the other rare earth metals;

C represents one or two or more of Co, Ni, Al, Cu, Pd, Rh, Au, Ag, Cr, Mn, V and B;

x is not less than 0 and not more than 0.5;

y is not less than 0 and less than 0.4; and z is more than 1.1 and less than 5.0.

2. Heat reserving materials of claim 1, wherein z is more than 1.5 and less than 3.3.

* * * * *